US007802938B2

(12) United States Patent
Goodfellow et al.

(10) Patent No.: US 7,802,938 B2
(45) Date of Patent: Sep. 28, 2010

(54) RESILIENT ROD FEATURE IN HANGING FILE FOLDER

(75) Inventors: Andrew Goodfellow, Phoenix, AZ (US); David Gruza, Phoenix, AZ (US); Christopher Holman, Mesa, AZ (US); Candie Harris, Brookville, NY (US); Braden Jones, Phoenix, AZ (US)

(73) Assignee: Esselte Corporation, Melville, NY (US)

( * ) Notice: Subject to any disclaimer, the term of this patent is extended or adjusted under 35 U.S.C. 154(b) by 0 days.

(21) Appl. No.: 11/860,982

(22) Filed: Sep. 25, 2007

(65) Prior Publication Data

US 2009/0080966 A1 Mar. 26, 2009

(51) Int. Cl.

| | |
|---|---|
| ***B42F 3/00*** | (2006.01) |
| ***B42F 13/00*** | (2006.01) |
| ***B42F 13/12*** | (2006.01) |
| ***B42F 13/40*** | (2006.01) |

(52) U.S. Cl. ..... 402/75; 402/4; 402/58; 402/70; 402/73; 402/80 R

(58) Field of Classification Search ..... 281/15.1, 281/21.1, 22, 29, 31, 38, 45, 46, 47, 48, 51; 402/70, 73, 79, 80 R, 501

See application file for complete search history.

(56) References Cited

U.S. PATENT DOCUMENTS

| | | | | |
|---|---|---|---|---|
| 577,218 A | | 2/1897 | Weis | |
| 3,971,572 A | * | 7/1976 | Fenkel | 281/46 |
| 4,305,510 A | | 12/1981 | Eppy | |
| 4,426,007 A | | 1/1984 | Beleckis | |
| 4,659,109 A | * | 4/1987 | Donovan | 281/46 |
| 4,771,557 A | * | 9/1988 | Bowman | 40/771 |

(Continued)

FOREIGN PATENT DOCUMENTS

| | | |
|---|---|---|
| GB | 2 279 038 | 12/1994 |

(Continued)

OTHER PUBLICATIONS

International Search Report for PCT/US2009/050555, mailed Nov. 12, 2009.

*Primary Examiner*—Dana Ross
*Assistant Examiner*—Justin V Lewis
(74) *Attorney, Agent, or Firm*—Pillsbury Winthrop Shaw Pittman LLP

(57) ABSTRACT

A binder for holding documents is disclosed. The binder has a spine with a pair of cover flaps attached to each side of the spine. Attached to the spine is a latching device, also referred to as a locking device, that includes a first retaining member, a latching member, and a second retaining member. The first and second retaining members are parallel to each other and extend perpendicular to a longitudinal axis of the spine. The binder is configured to hold a plurality of document modules, each of which hold a set of documents, which are flexible sheets of material, such as paper or plastic. Each module has first and second ends. The first end is contoured to mate with a portion of an external profile of the first retaining member. The second end attaches to the second retaining member. The latching member moves between a latched position where it engages the first end of the module and an unlatched position where it is not engaged to the first end of said module.

38 Claims, 12 Drawing Sheets

U.S. PATENT DOCUMENTS

| | | | | | |
|---|---|---|---|---|---|
| 5,056,823 | A | * | 10/1991 | Stancato | 281/49 |
| 5,104,147 | A | | 4/1992 | King | |
| 5,183,296 | A | | 2/1993 | Policht | |
| 5,433,480 | A | * | 7/1995 | Gresham et al. | 281/17 |
| 5,709,494 | A | | 1/1998 | Deutsch | |
| 5,725,251 | A | | 3/1998 | Heggeland | |
| 5,964,480 | A | | 10/1999 | Chen | |
| 6,206,426 | B1 | * | 3/2001 | Azzato | 281/45 |
| 6,994,377 | B2 | | 2/2006 | Büttner | |
| 2007/0085331 | A1 | | 4/2007 | Mueller | |

FOREIGN PATENT DOCUMENTS

| | | |
|---|---|---|
| GB | 2 323 815 | 10/1998 |
| GB | 2 422 134 | 7/2006 |

* cited by examiner

DETAIL A

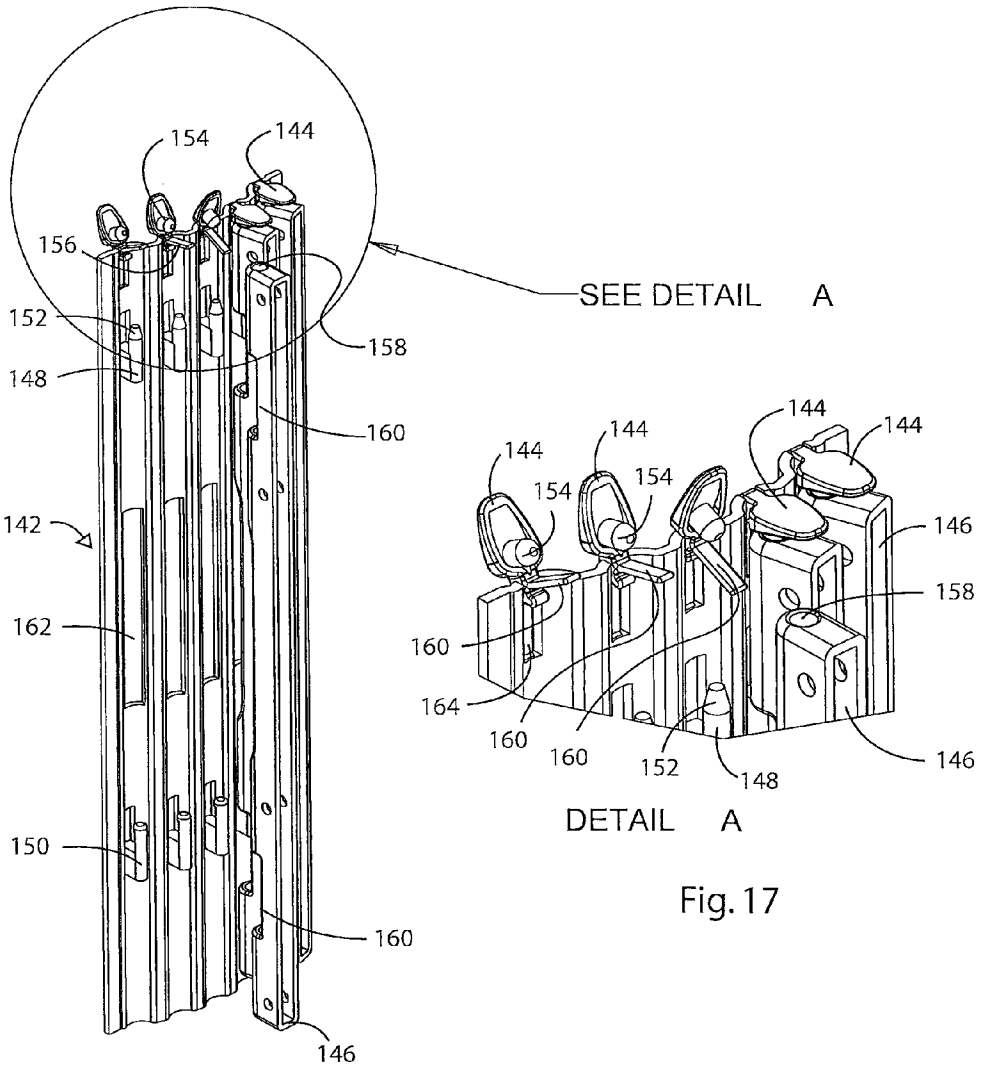
Fig. 16
Fig. 17
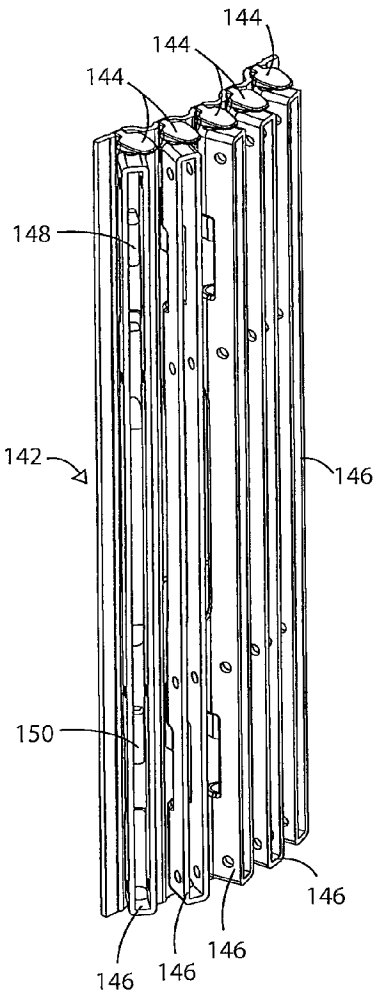
Fig. 15

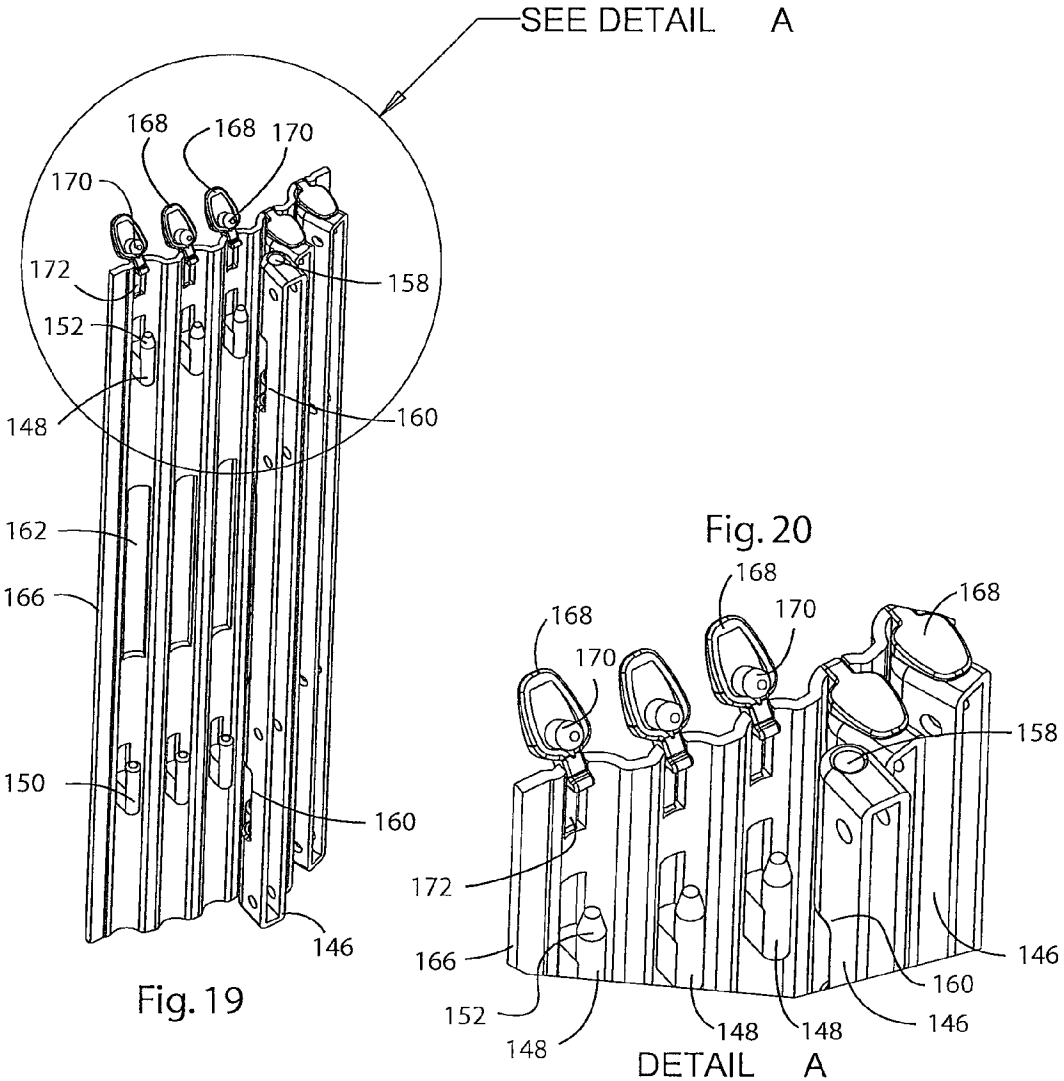
Fig. 20
Fig. 19
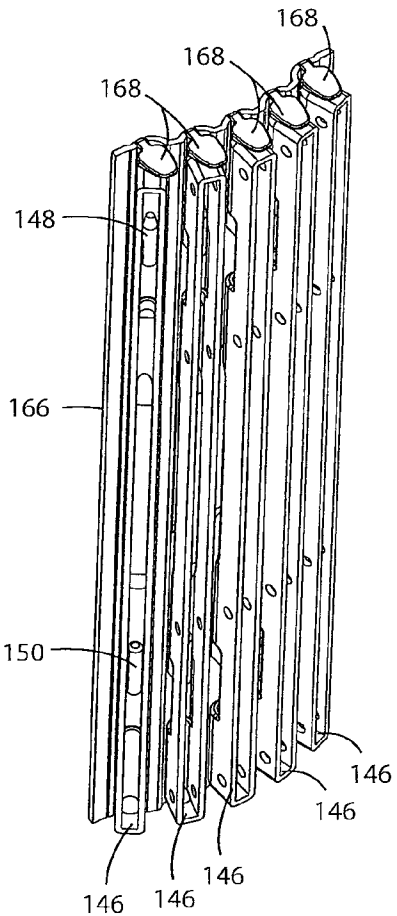
Fig. 18

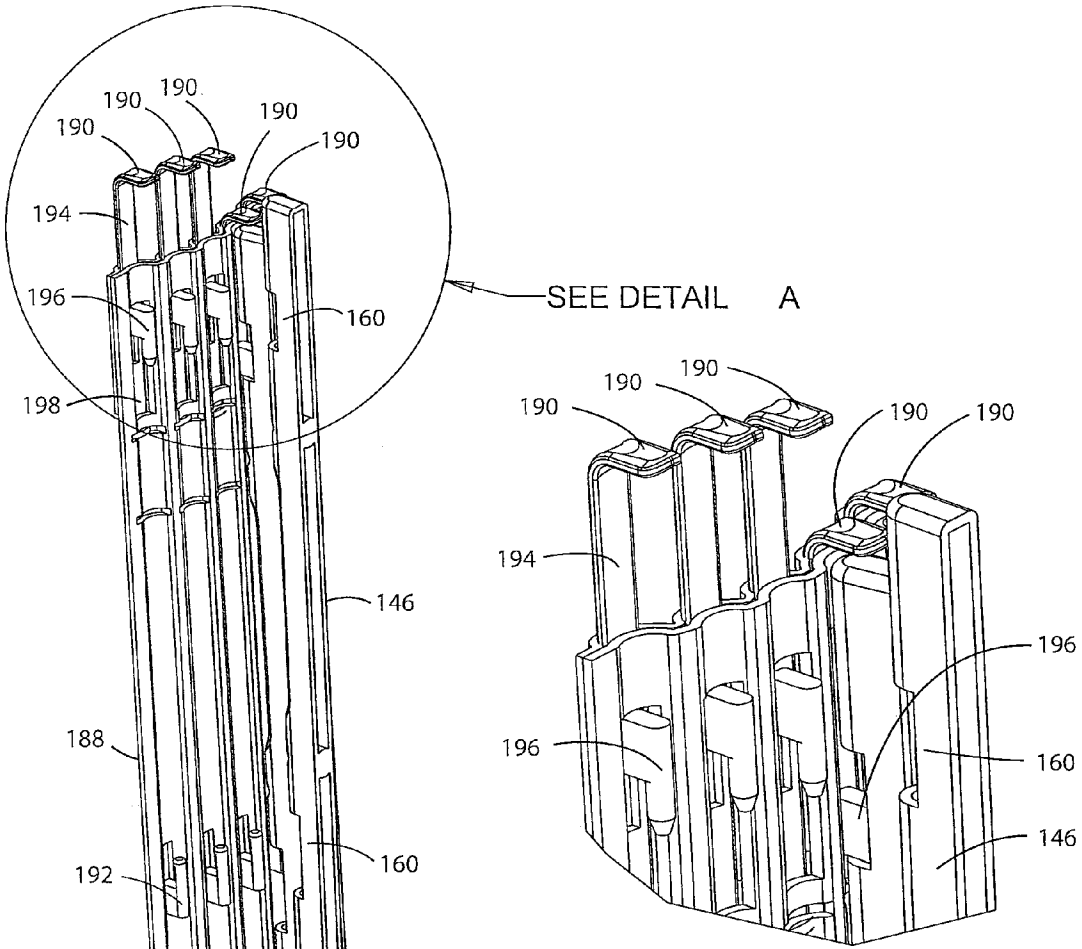
Fig. 25
DETAIL A
Fig. 26
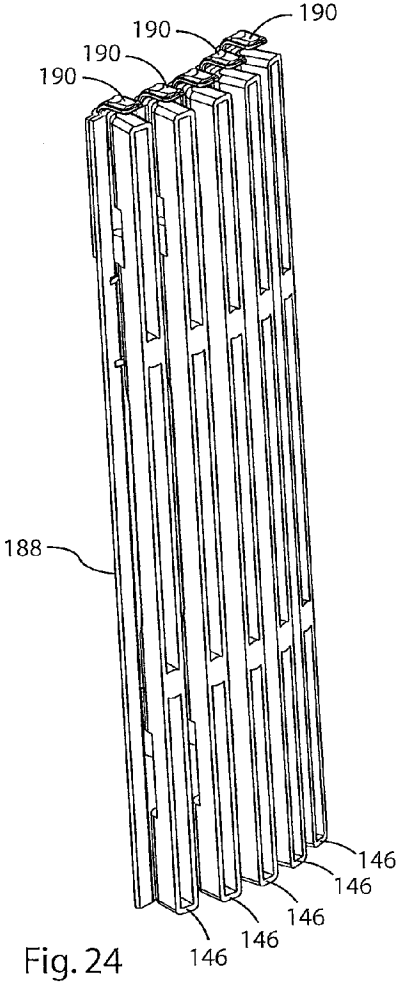
Fig. 24

RESILIENT ROD FEATURE IN HANGING FILE FOLDER

FIELD OF THE INVENTION

The present invention relates to the field of systems for organizing documents, and more particularly to a modular filing system for holding documents in a binder.

BACKGROUND OF THE INVENTION

Systems for organizing and holding documents are well-known and exist in many varieties. A common system for organizing documents is with a ring-type binder. These ring-type binders typically include a plurality of loose-leaf page retaining members positioned longitudinally between opposing ends of such binders. The page retaining members are configured to extend through corresponding apertures in the preferred loose-leaf elements thereby retaining the loose-leaf elements in the ring-type binder.

These retainers are usually spring-loaded, frequently, but not invariably circular (some rings are D-shaped, others are actually rods), and may or may not have additional latching systems. In some ring-type binders, the page retaining members include two separable members which, then adjoined, form a loop for retaining loose-leaf elements. These separable page retaining members are configured to permit the user to insert loose-leaf elements in the binder and to remove or replace loose-leaf elements retained therein.

In other ring-type binders, the page retaining members do not separate in a manner which enables the user to insert or replace loose-leaf elements. These ring-type binders may take the form of a conventional spiral or other notebooks wherein the loose leafs are fixed therein using a continuous wire member configured in a helix or other manner so as to define a plurality of loose-leaf page retaining members.

Binders come in many standard sizes with respect to both capacity and paper size. The most common type in the United States is a three ring system for letter size pages (8½×11 in), whereas most other countries use a two or four hole system for holding A4 sheets. The lever arch system is particularly useful for larger amounts of paper. Some personal organizers and memorandum books use a six or seven hole system.

Most binder covers are made of three pieces, in the fashion of a hardback book, but are produced in many styles. Materials vary widely. Some vinyl binders have a clear pocket on the outside for cover pages, and many have pockets in the inner cover for loose papers, business cards, compact discs, etc. There are also zipper binders, which zip the binder up and keep papers from falling out.

SUMMARY OF THE INVENTION

A binder for holding documents is disclosed. The binder has a spine with a pair of cover flaps attached to each side of the spine. Attached to the spine is a latching device, also referred to as a locking device, that includes a first retaining member, a latching member, and a second retaining member. The first and second retaining members are parallel to each other and extend perpendicular to a longitudinal axis of the spine. The binder is configured to hold a plurality of document modules, each of which hold a set of documents, which are flexible sheets of material, such as paper or plastic. Each module has first and second ends. The first end is contoured to mate with a portion of an external profile of the first retaining member. The second end attaches to the second retaining member. The latching member moves between a latched position where it engages the first end of the module and an unlatched position where the first end of said module may be removed from said binder.

In a further embodiment, a binder for holding a plurality of flexible sheets is disclosed. The binder has a spine having top and bottom ends. The binder has a module locking device comprised of a locking member and an attaching surface at the top end. The binder is configured to hold a module removeably attached to said spine. The module is configured for holding the plurality of flexible sheets. The module has a contoured end configured to engage an outer surface of the attaching surface. The locking member moves between a locked position where it engages the end of the module holding the module in a removeably attached position, and an unlocked position where the module may be removed from said binder.

In an additional embodiment, a binder for holding a plurality of flexible sheets is disclosed. The binder has a spine and a pair of cover flaps attached to the spine. A rod is attached to the spine. The rod is positioned parallel to a planar surface of the spine and perpendicular to a lengthwise axis of the spine. The binder includes a locking device which holds a plurality of modules removeably attached to the spine between the cover flaps. Each of the plurality of modules has a first end that includes a curved surface configured to mate with an external curved surface of the rod. The locking device is moveable over the first end of each of the plurality of modules, wherein one of the plurality of modules is removeably attached to the spine when the curved surface of the first end is mated with the rod and the locking device is in a locked position.

In one embodiment, the module is pivotable with respect to the spine when it is removeably attached to the spine. In a further embodiment, the spine is laterally expandable to accommodate modules of varying width. In one embodiment, the second retaining member is a rod. In another embodiment, the second retaining member is a hook. In another embodiment, the second end of the module has a contour configured to mate with a portion of an external profile of the rod. In other embodiments, the latching member pivots between latched and unlatched positions. Alternatively, the latching member slides between latched and unlatched positions. In further embodiments, a latching rod or curved latching surface is attached to the latching member. In a still further embodiment, the latching member has an ergonomic surface.

The objects and features and advantages of the present invention will become apparent from the following detailed description, the accompanying drawings, and the appended claims.

BRIEF DESCRIPTION OF THE DRAWINGS

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings, wherein:

FIG. 15 illustrates a perspective view of a binder spine having a plurality of modules attached to a plurality of latching devices;

FIG. 16 illustrates a perspective view of a binder spine showing the various interactions of modules with the latching devices;

FIG. 17 illustrates a detailed perspective view of the latching devices;

FIG. 18 illustrates a perspective view of a binder spine having a plurality of modules attached to a plurality of latching devices;

FIG. 19 illustrates a perspective view of a binder spine showing the various interactions of modules with the latching devices;

FIG. 20 illustrates a detailed perspective view of the latching devices;

FIG. 24 illustrates a perspective view of a binder spine having a plurality of modules attached to a plurality of latching devices;

FIG. 25 illustrates a perspective view of a binder spine showing the various interactions of modules with the latching devices; and FIG. 26 illustrates a detailed perspective view of the latching devices.

DETAILED DESCRIPTION

While the invention has been shown and described with reference to a particular embodiment thereof, it will be understood to those skilled in the art, that various changes in form and details may be made therein without departing from the spirit and scope of the invention.

Figure 1:
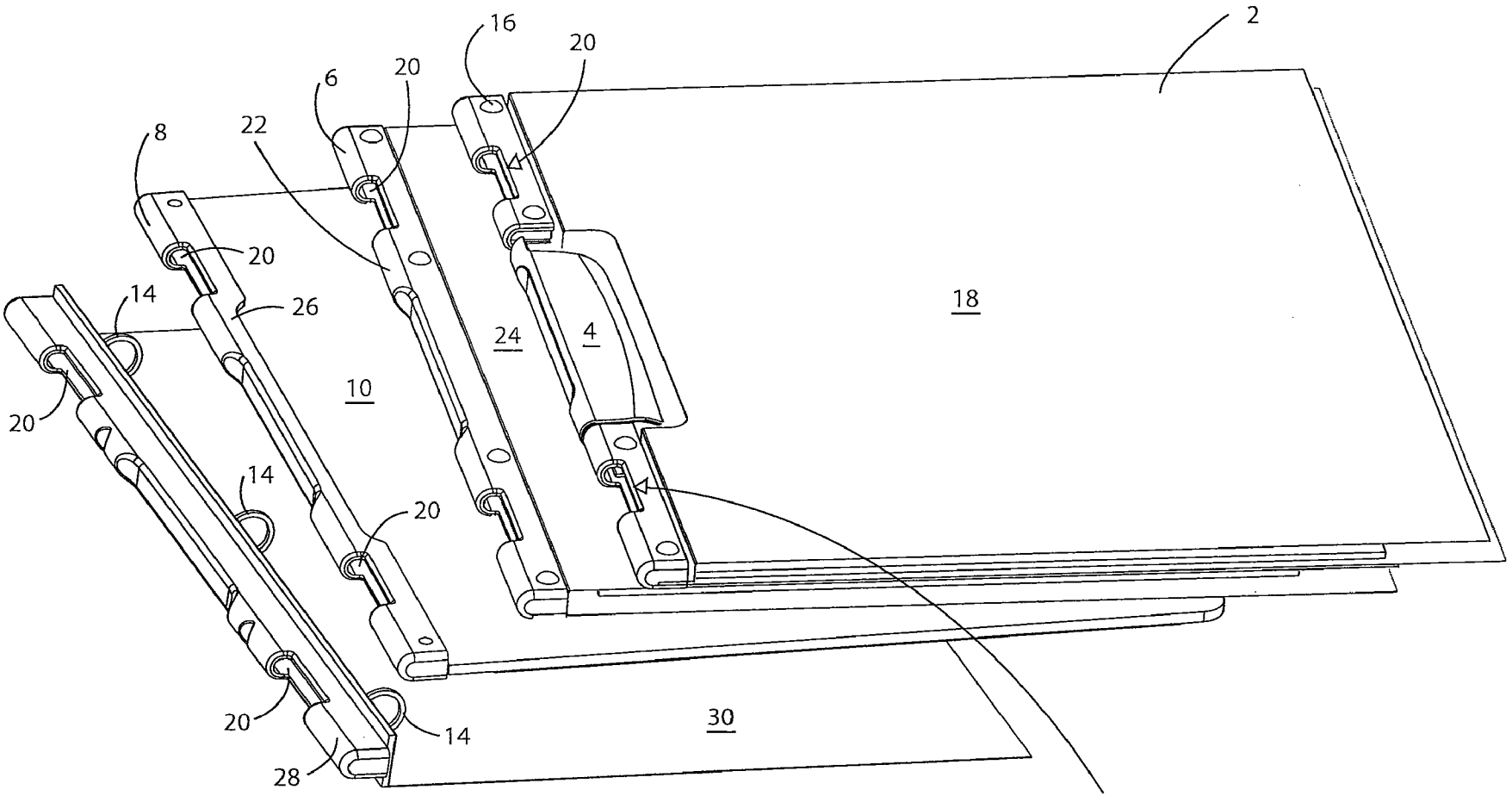
FIG. 1 depicts four types of document modules, a hook-type document module having a document clip, a hook-type document module that supports an ESSELTE PENDAFLEX GATELOCK folder, a hook-type document module that has a pocket, and a hook-type document module having a three-ring binding system.

FIG. 1 depicts four types of document modules, a hook-type document module 2 having a document clip 4, a hook-type document module 6 that supports an ESSELTE PENDAFLEX GATELOCK folder, a hook-type document module 8 that has a pocket 10, and a hook-type document module 12 having a three-ring binding system 14.

Figure 2:
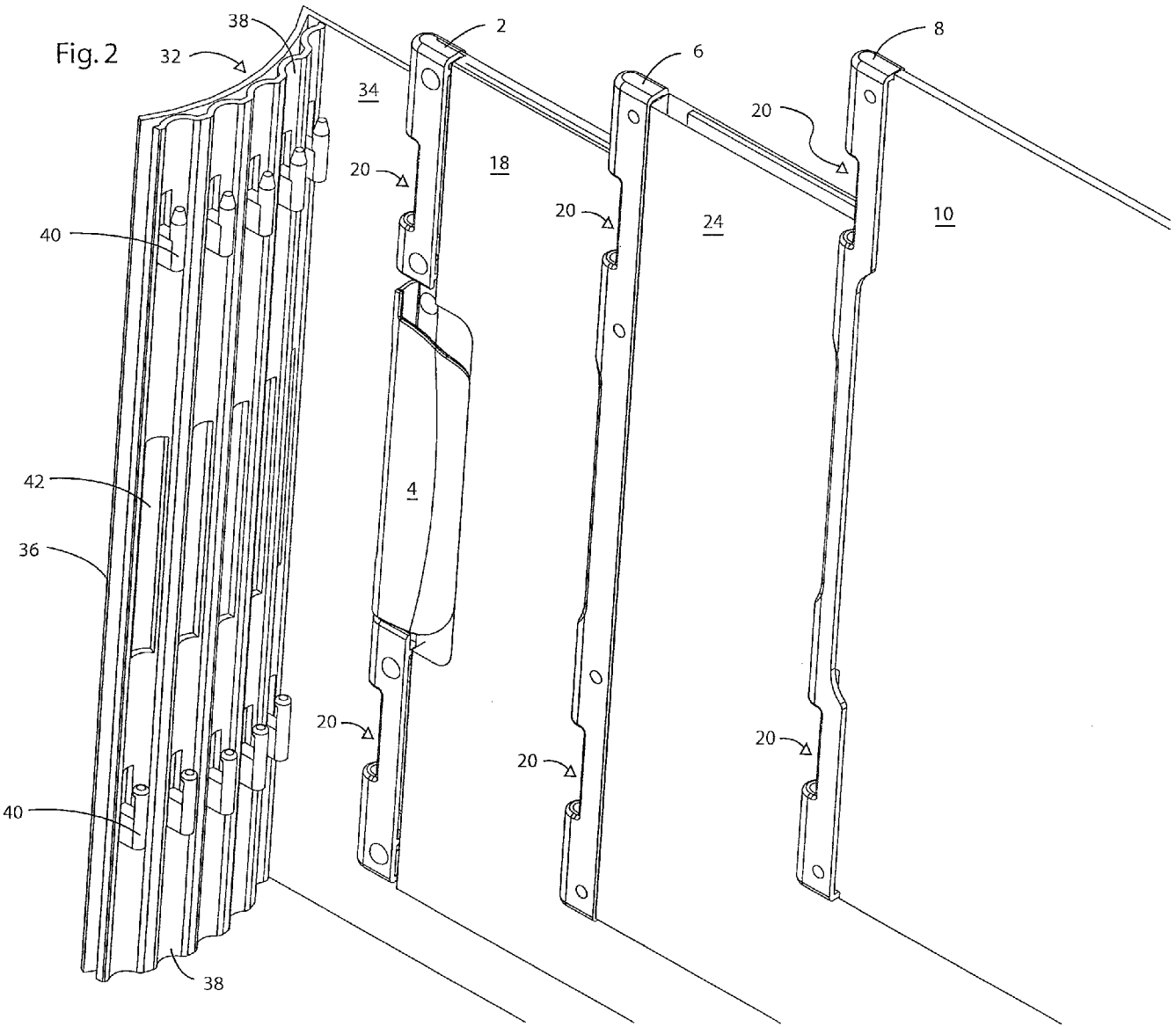
FIG. 2 depicts the insertion of hook-type document modules into a binder.

Document module 2 includes a spine 16 and cover sheets 18. Cover sheets 18 may be formed, in an exemplary embodiment, from either plastic or paper, or other exemplary material. In one exemplary embodiment, cover sheets 18 are formed from clear plastic. Document module 2 includes a clip 4 for grasping a plurality of documents (not shown). Channel openings 20, also referred to as receiving spaces, are formed near each end of spine 16. Channel openings 20 engage hooks or other connectors formed in the spine of the binder, which is depicted in FIG. 2.

Document module 6 includes a spine 22 with channel openings 20 formed at each end, which together support an ESSELTE PENDAFLEX GATELOCK folder. Spine 22 is attached to a cover 24 for holding documents (not shown) in spine 22.

Document module 8 has a spine 26 that secures a flexible pocket 10 for holding documents (not shown). Spine 28 includes channel openings 20 for removeably attaching document module 8 to the binder shown in FIG. 2.

Document module 12 has a three-ring binding system 14. Module 12 has a spine 28 that supports a three-ring binding system 14 for securing documents that are protected by cover 28. The binding system 14 may be of any construction, and is not necessarily limited to three rings. Module 12 includes channel openings 20 for removeably attaching module 12 to the binder shown in FIG. 2.

FIG. 2 depicts the insertion of hook-type document modules 2, 6 and 8 into a binder 32. Binder 32 is shown in a cutaway view having one cover flap 34. Binder 32 includes a spine 36 that is provided with a plurality of parallel channels 38, each of which includes a pair of hook-type connectors 40 which are positioned at each end of spine 32. Each hook-type connector 40, in this exemplary non-limiting embodiment, is made of a rod having a tapered end. Each rod is positioned parallel to a lengthwise axis of spine 36. Each rod is attached to a base that is attached to spine 36. Each hook-type connector 40 is positioned to have the hook-type connector 40 directed up along the length of spine 36, thereby enabling hook-type connectors 40 to hold modules 2, 6 and 8 in binder 32. Windows 42 are included in spine 36 to enable the spines of each module 2, 6 and 8 to be visible from outside binder 32 when the modules are attached to spine 32. In one exemplary embodiment, the spines of modules 2, 6 and 8 are provided with identifying labels which are readable external to binder 32 through windows 42.

Figure 3:
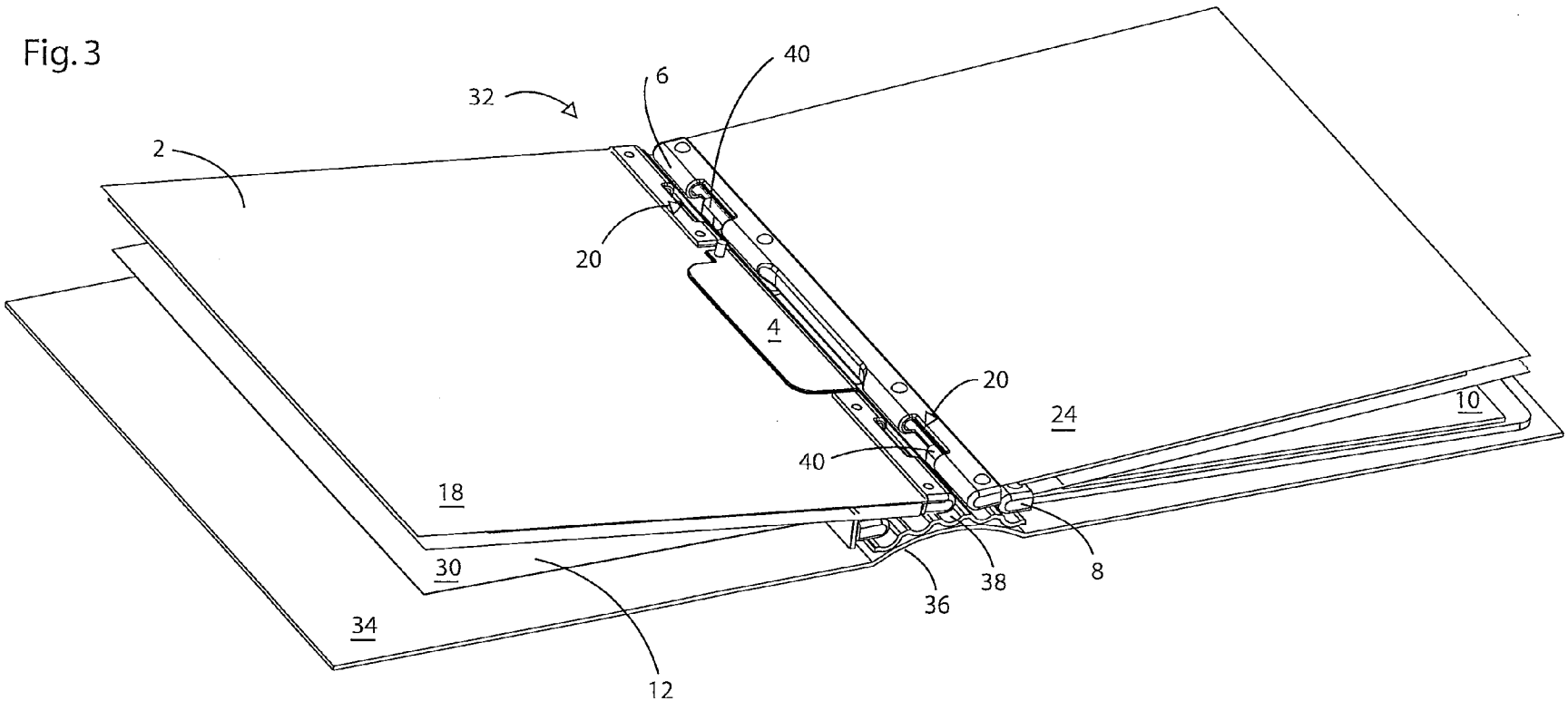
FIG. 3 depicts an open binder holding a plurality of hook-type document modules.

FIG. 3 depicts an open binder 32 holding a plurality of hook-type document modules 2, 6, 8 and 12. Documents modules 2, 6, 8 and 12 are attached to binder 32. Binder 32 is shown laid open with cover flaps 34 resting on a planar surface. When in this laid open position, modules 2, 6, 8 and 12 pivot with respect spine 36 of binder 32, enabling modules 2, 6, 8 and 12 to lay flat with respect to covers 34. Further, by enabling modules 2, 6, 8 and 12 to pivot with respect to spine 36, it is possible to rotate and flip through modules 2, 6, 8 and 12 for viewing when binder 32 is in this laid-open position. Modules 2, 6, 8 and 12, in an exemplary embodiment, form a snap-fit with hook-type connectors 40. Modules 2, 6, 8 and 12 may be removed individually from binder 32, thereby allowing access to the documents contained within each individual module 2, 6, 8 and 12.

Figure 4:
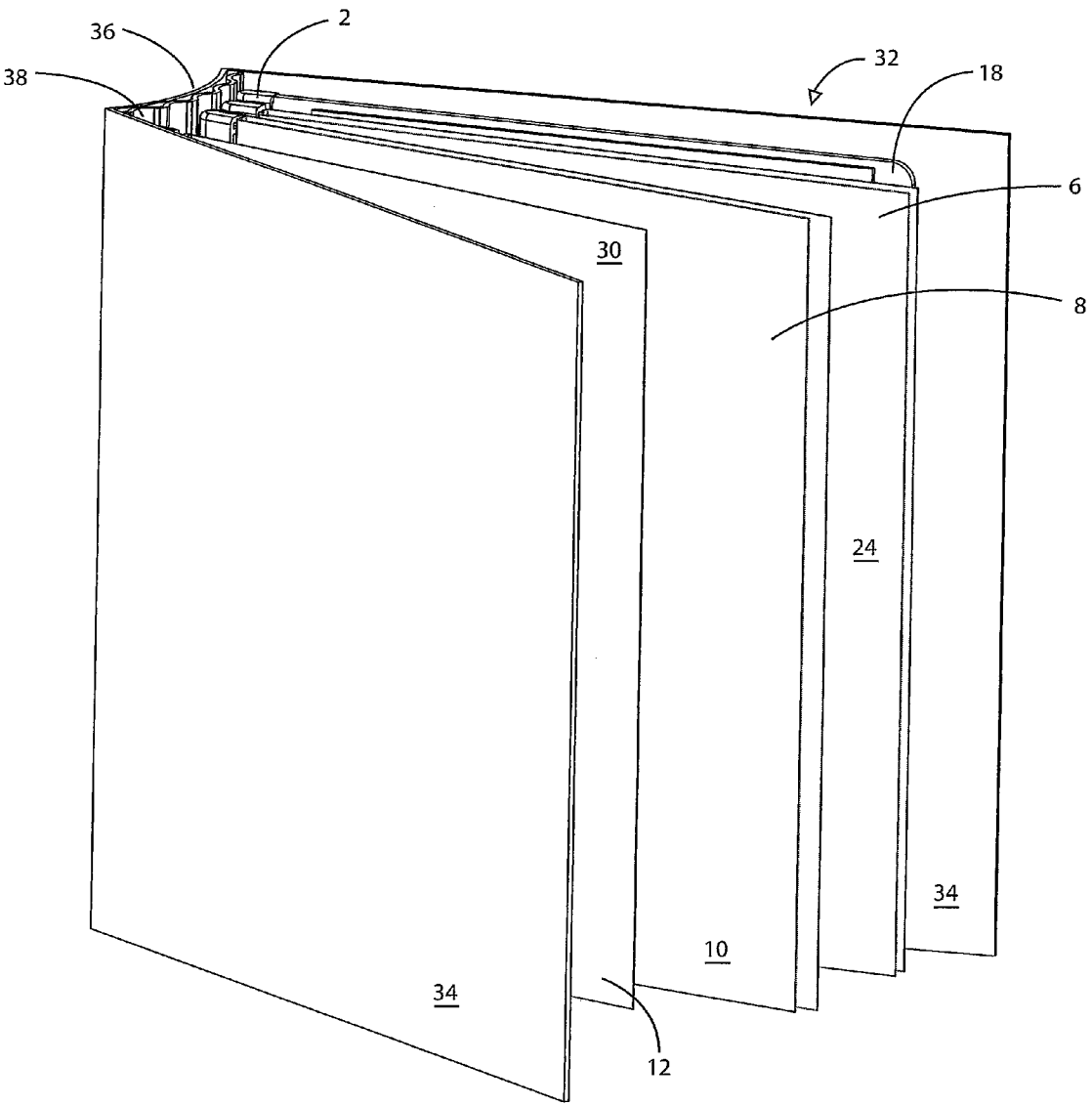
FIG. 4 depicts a closed binder holding a plurality of hook-type document modules.

FIG. 4 depicts a closed binder 32 holding a plurality of hook-type document modules 2, 6, 8 and 12. Binder 32 is shown in an upright position with cover flaps 34 generally closed. In This configuration, hook-type connectors 40 hold modules 2, 6, 8 and 12 in position within binder 32. Binder 32 may be moved around, opened, and placed in all manner of positions and remain able to hold modules 2, 6, 8 and 12 within binder 32, until a user desires to remove them.

Figure 5:
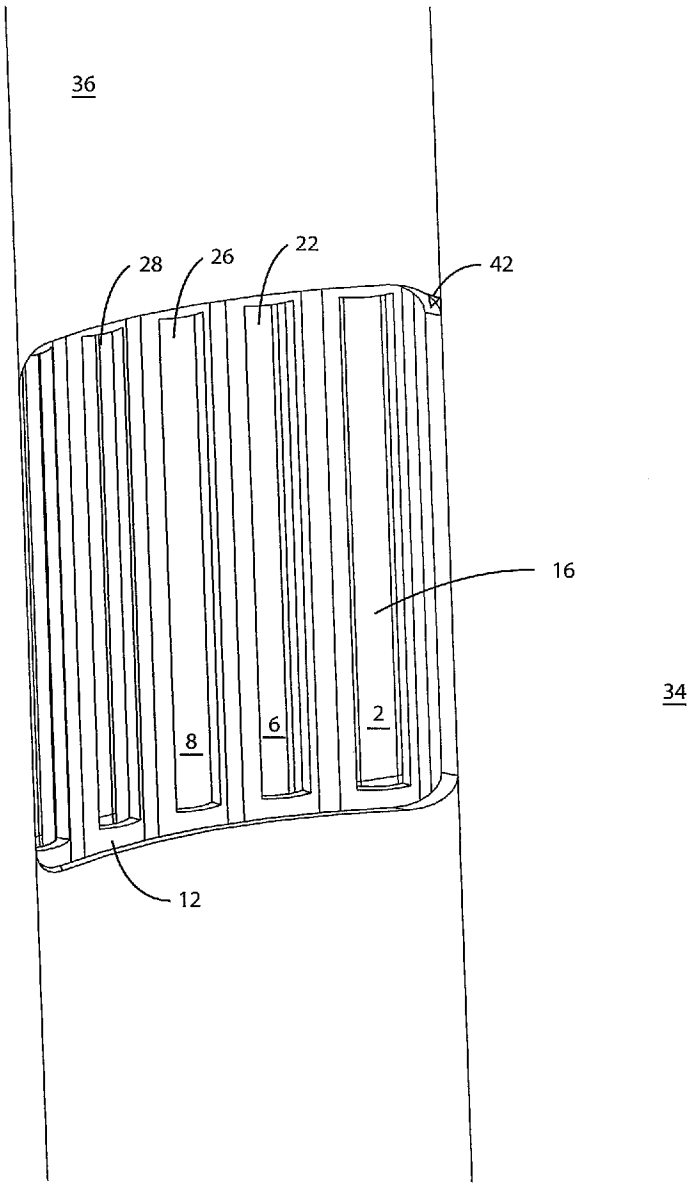
FIG. 5 depicts a view of a binder spine illustrating a plurality of windows for viewing labels on the spines of document modules.

FIG. 5 depicts a view of a binder spine 36 illustrating a plurality of windows 42 that enable the spines of modules 2, 6, 8 and 12 to be visible external to binder 32. Spine 36 of binder 32 is provided with a window 42 through which the spines of modules 2, 6, 8 and 12 are visible. In an exemplary embodiment, modules 2, 6, 8 and 12 are provided with labels, colors, or some other means of visual identification on their spines. Thus, it is possible to identify which modules 2, 6, 8 and 12 are contained within binder 32 by merely looking through window 42, without having to open binder 32 and individually inspect each module separately.

Figure 6:
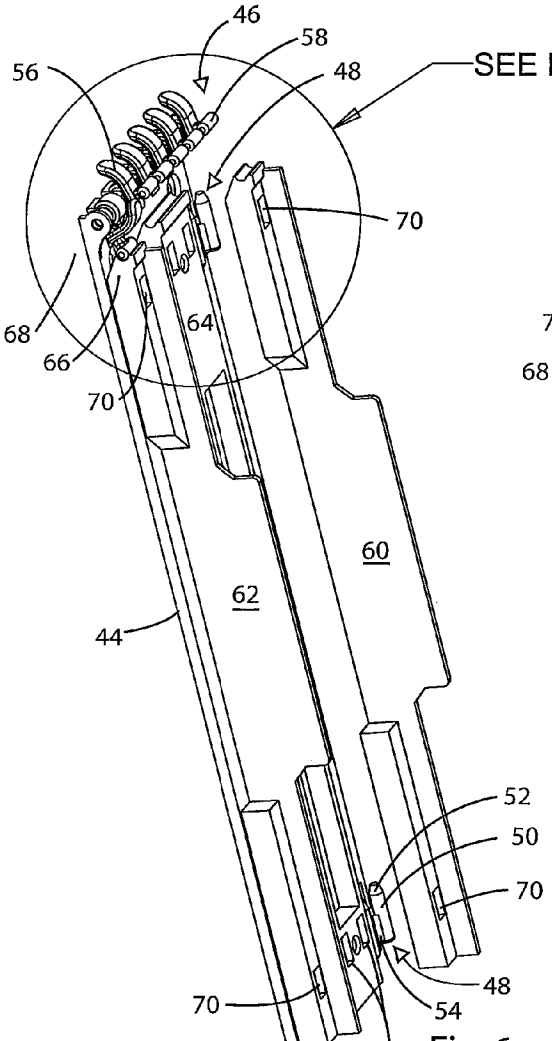
FIG. 6 depicts a perspective view of a binder spine.

FIG. 6 depicts a perspective view of a binder spine 44. Binder spine 44 includes a top end having a latching device 46, also referred to as a locking device. Below latching device 46 is a hook-type connector 48 that includes a rod 50 having a tapered end 52. Rod 50 is attached to spine 44 with a support 54. A hook-type connector 48 is also positioned at a bottom end of spine 44. A pair of hook-type connectors 48 is provided for each module. Together, a pair of hook-type connectors 48 and latching device 46 function to removeably attach a module to binder 44. Latching device 46 includes an ergonomic surface 56 to enable the finger or thumb of a user to manipulate an individual latching device 46. In this figure, latching device 46 is shown to include five different latching devices, thereby enabling binder 44 to hold up to five different modules. These use of five different latching devices 46 is merely exemplary. Any number of latching devices 46 may be used. Attached to each latching device 46 is a rod 58. Rod 58 is positioned parallel to the planar surface of spine 44 and is perpendicular to the lengthwise axis of spine 44. Each latching device 46 is pivotally mounted to spine 44 and is capable of independent motion. Attached to binder spine 44 are module spines 60, 62 and 64. Module spines 60 and 62 each attach to a pair of hook-type connectors 48 and are each then locked into position on binder spine 44 by a single latching device 46. Module spine 64 is a double-wide module and attaches to four hook-type connectors 48 and is secured to binder spine 44 by two separate latching devices 46. Each module 60, 62 and 64 is provided with a contoured surface 66 at the top end of each module. The contoured surface 66 is configured to mate with the contoured surface of rod 58. In this exemplary embodiment, the contour of rod 58 and surface 66 are both curved.

FIG. 6 shows one latching connector 68 pivoted into a latched or locked position where rod 58 engages curved surface 66. Module spine 60, 62 and 64 each are provided with channel openings 70 for receiving and connecting to hook-type connectors 48. To attach a module spine 60, 62 or 64 to binder 44, channel openings 70 are positioned over hook-type connectors 48 and are slid into position such that hook-type connectors 48 hold module spines 60, 62 and 64 in position. Once module spine 60, 62 or 64 is connected to hook-type connectors 48, latching device 46 is pivoted into position where rod 58 engages curved surface 66 on the end of module spines 60, 62 and 64. Note that the us of rods 58 is merely exemplary. In an alternative embodiment, spheres or ellipsoids may be used instead of rods 58 to mate with the curved surfaces 66 of modules 60, 62 and 64. Other solid shapes may be used to mate with surfaces 66, such as triangular or rectangular shapes. The contours of surface 66 preferably match the contour of whatever shape is used in place of rod 58. Rod 58 keeps spines 60, 62 and 64 from moving parallel to spine 44. Together, rod 58 and hook-type connectors 48 hold module spines 60, 62 and 64 in removeably attached position on spine 44. In order to remove one of the spines 60, 62 or 64 from binder spine 44, a user would press ergonomic surface 56 in order to pivot rod 58 away from contoured surface 66. Once rod 58 is pivoted out of position, module spines 60, 62 or 64 can be slid out from engagement with hook-type connectors 48 and removed from binder spine 44.

Figure 7:
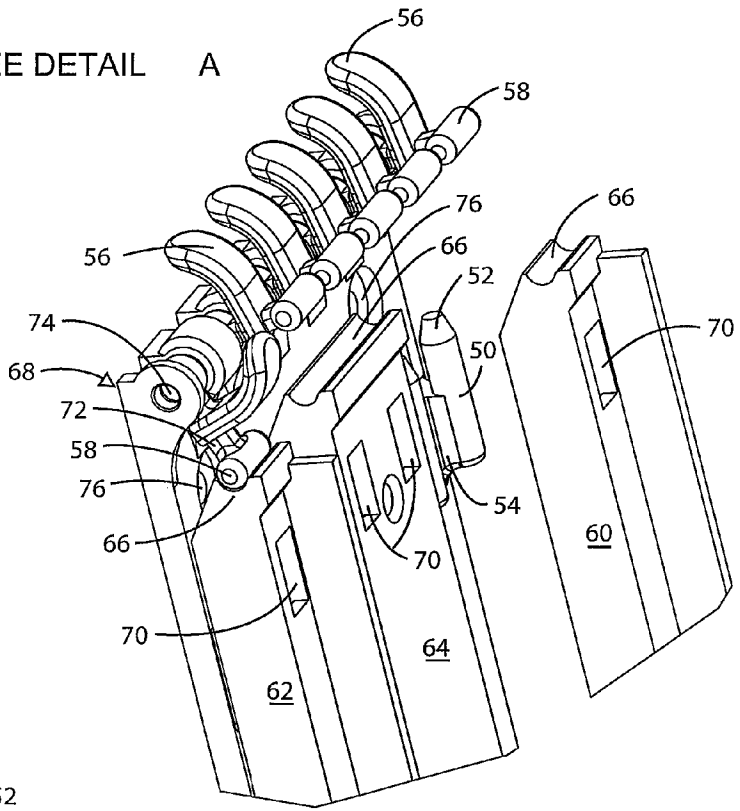
FIG. 7 depicts a detailed view of a latching device.

FIG. 7 depicts a detailed view of a latching device 46. Each latching device 46 includes a rod 58 configured to engage contoured surface 66 placed at the end of each module spine 60, 62 and 64. Each rod 58 is attached to the pivotally mounted ergonomic surface 56 by a support 72. Latching devices 46 are pivotally attached to binder spine 44 by pivot rod 74 that runs through each latching device 46. Binder spine 44 is attached to binder 32 with fasteners that attach through openings 76 in the top end of binder spine 44.

Document modules, in an exemplary embodiment, come in varying widths. Documents modules 60 and 62 are single width modules and each attach to a single pair of hook-type connectors 48 and a single latching device 46. Document module 64 is a double-width module and connects to four hook-type connectors 48 and a pair of latching devices 46. Other sizes for modules are possible, such as triple-width or quadruple-width modules. Since each module is separately secured with a different latching device 46, each module may be separately removed from binder 44 without affecting the attachment of the other modules to binder 44.

Figure 8:
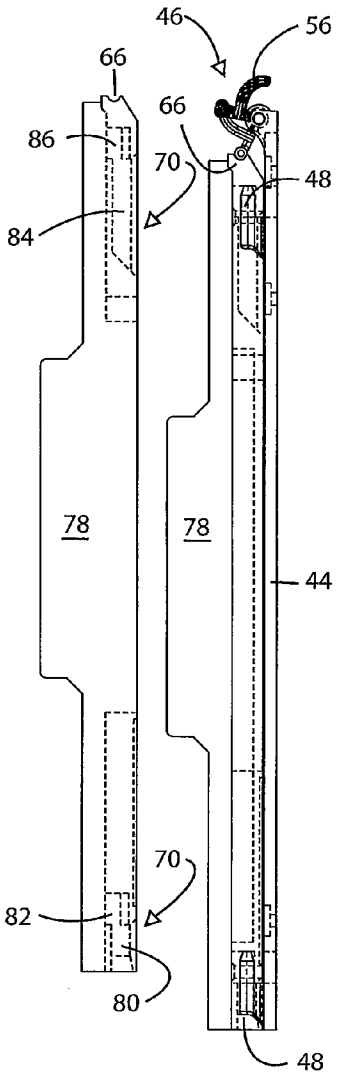
FIG. 8 depicts a side view of a binder spine configured to receive hook-type connectors.

FIG. 8 depicts a side view of a module spine 78 configured to receive hook-type connectors 48. The dashed lines show the internal structure of module spine 78. Module spine 78 is shown at left separately from binder spine 44. Module spine 78 has channel openings 70 configured to receive hook-type connectors 48. The channel opening 70 at the bottom end of module spine 78 is formed of two interconnected chambers 80 and 82. The channel opening 70 at the top end of module spine 78 is also formed of two interconnected chambers 84 and 86.

Rod 50 and support 54 are configured to engaged chambers 80, 82, 84 and 86 in order to secure module 78 to binder spine 44. When attaching module spine 78 to binder spine 44, rods 50 initially enter chambers 80 and 84. Rods 50 are then pushed up and into chambers 82 and 86 as spine 78 is pressed down and slid over binder spine 44. Once in chambers 82 and 86, rods 50 holds module spine 78 against binder spine 44. Latching device 46 is then pivoted into a latched position where curved surface 66 at the end of module spine 78 is engaged by rod 58 on latching device 48, thereby holding document module 78 in position against hook-type connectors 48.

Figure 9:
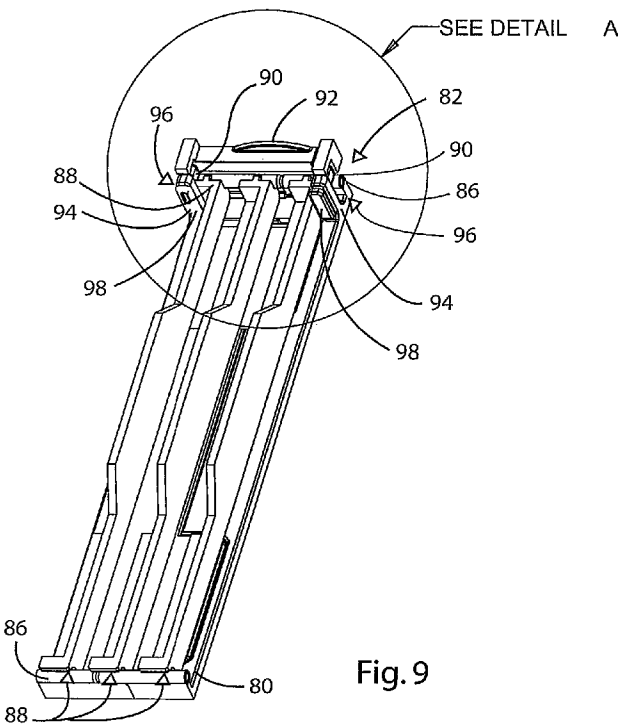
FIG. 9 depicts a side view of a binder spine.

FIG. 9 depicts a side view of a binder spine 80 having a latching device 82 in conformance with an alternative embodiment. Binder spine 80 is shown as being attached to three module spines 84. Module spines 84 are depicted as having the same width. Module spines 84 may, in an exemplary embodiment, be manufactured having varying widths. In this embodiment, binder spine 80 does not have hook-type connectors 40. Binder spine 80 is provided with a pair of module rods 86 at each end. Module rods 86 are parallel to the plane formed by binder spine 80 are as positioned perpendicular to the lengthwise axis of binder spine 80. Module spines 84 are provided with a contoured surface 88 at each end. Contoured surfaces 88 are configured to mate with a portion of the external surface of module rods 86. Contoured surfaces 88 and rods 86 have substantially similar surface configurations.

Together, contoured surfaces 88 and rods 86 hold module spines 84 against binder spine 80. Latching device 82 is a bar that slides on tracks 90 mounted on the top edges of binder spine 80. Latching device 82 slides back and forth along tracks 90. The direction that latching device 82 travels along tracks 90 is along the lengthwise axis of binder spine 80. Latching device 82, also referred to as a locking device, slides between a latched and unlatched position. In FIG. 9, latching device 82 is shown in an unlatched or unlocked position. When in an unlocked positioned, module spines 84 may be attached and removed to binder spine 80 by engaging contoured surfaces 88 with rods 86. Latching device 82 is provided with an ergonomic surface 92 to facilitate actuating its motion between latched and latched positions.

On either side of modules 84 are raised portions 94 that include openings 96 through which tracks 90 travel, thereby enabling latching device 82 to slide. Latching device 82 includes a pair of tracks 90 which protrude through openings 96. Mounted at the end of each track 90 is a stop 98. Stops 98 prevent latching device 82 from being pulled completely off spine 80 when latching device 82 is moved into an unlatched position. Latching device 82 snaps into a latched or locked position, thereby holding latching device 82 in position. When in this unlatched position, the bar forming latching device 82 extends away from the top portion of the ends of modules 84 having contoured portions 88, thereby allowing these ends to be separated and removed from spine 80.

Figure 10:
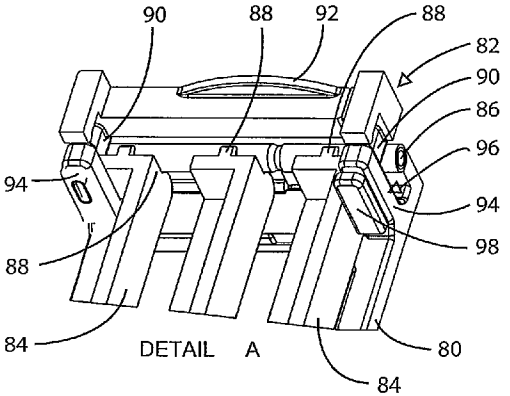
FIG. 10 depicts a detailed view of a latching device.

FIG. 10 depicts a detailed view of a latching device 82. Tracks 90 which slideably attaches latching device 82 to spine 80. Tracks 90 extend through openings 96 formed in raised portions 94. Tracks 90 have stops 98 attached at each end to keep latching device 82 from sliding off spine 80. Latching device 82 is provided with an ergonomic surface 92 to facilitate actuation of latching device 82. Stops 98 are shown abutting raised portions 94.

Figure 12:
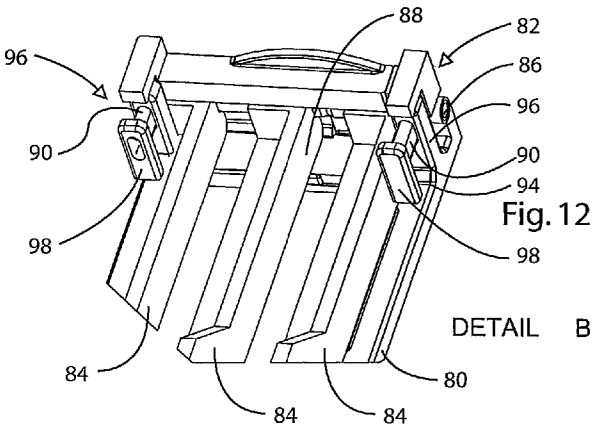
FIG. 12 depicts a detailed view of a latching device.
Figure 11:
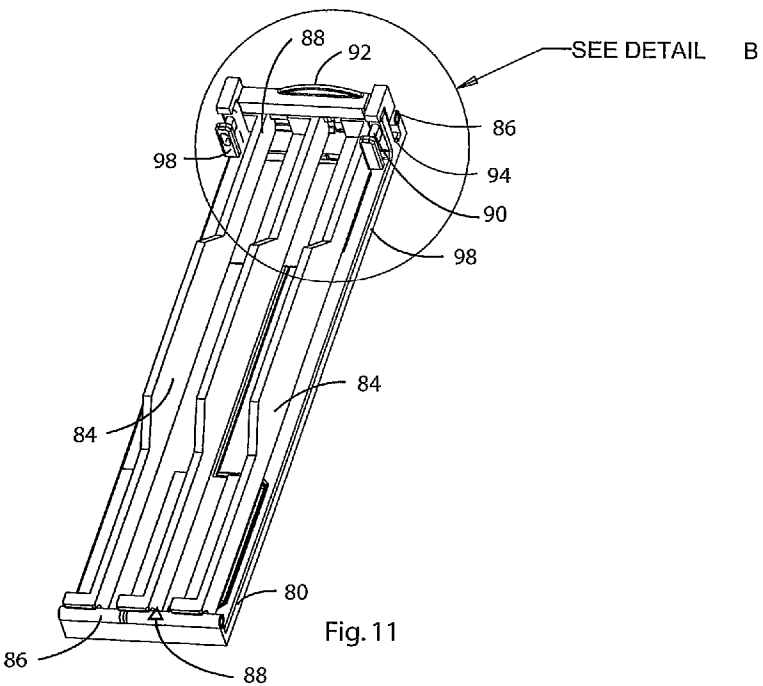
FIG. 11 depicts a perspective view of a binder spine.

FIG. 11 depicts a perspective view of a binder spine 80. Binder spine 80 is shown as having latching device 82 positioned in a latched or locked configuration. In this latched configuration, tracks 90 extend through openings 96. Stops 98 are pushed back away from raised portions 94. When in this latched position, the bar forming latching device 82 extends directly on top of the contoured portions 88 of module spines 84, thereby holding them against spine 80. FIG. 12 depicts a detailed view of a latching device 82 when in a latched position.

Figure 14:
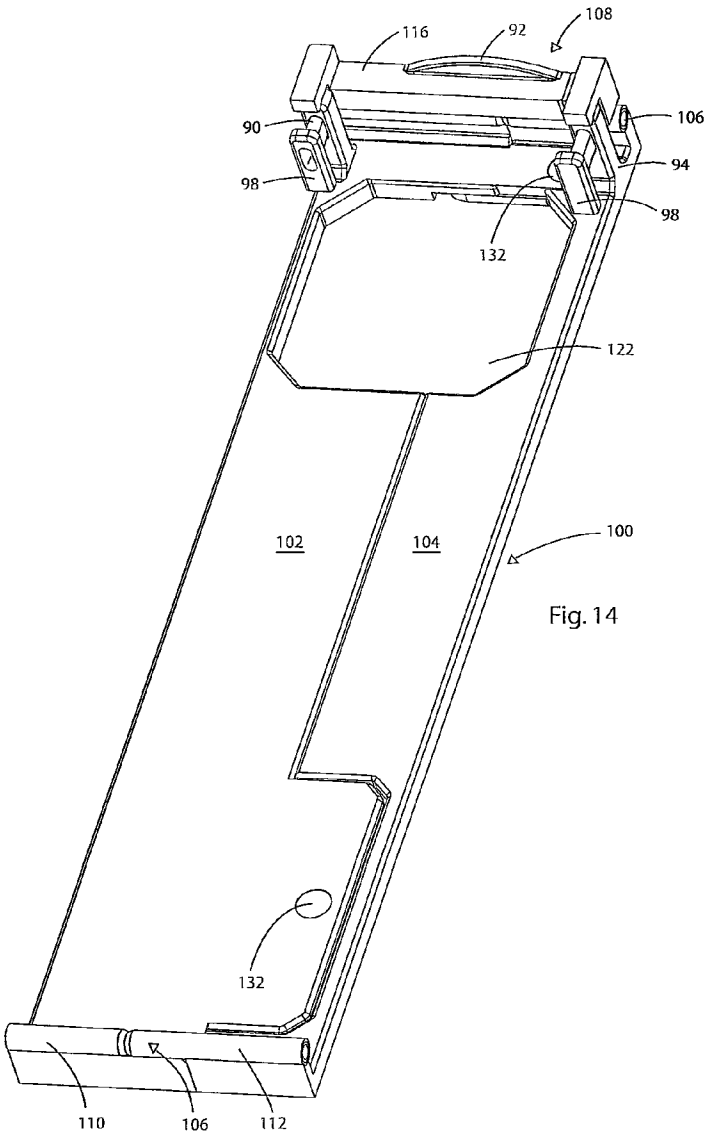
FIG. 14 depicts a perspective view of a laterally expandable spine in an unexpanded configuration.
Figure 13:
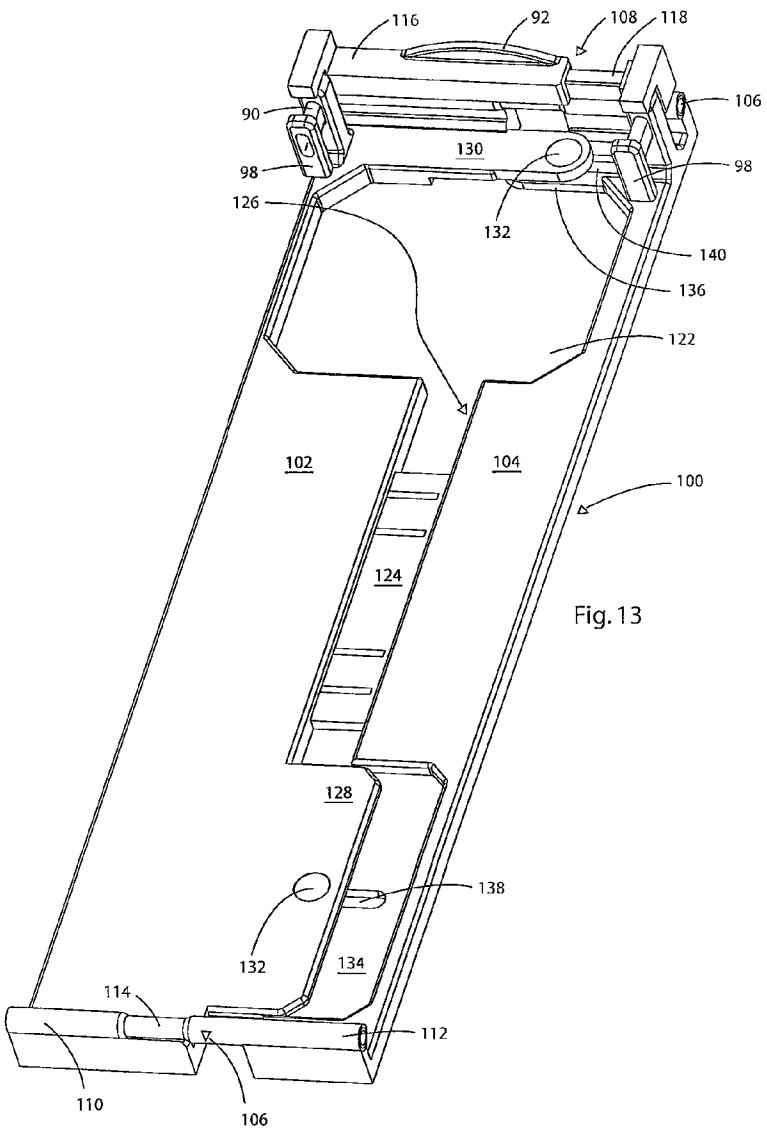
FIG. 13 depicts a perspective view of a laterally expandable spine in an expanded configuration.

FIG. 13 depicts a perspective view of a laterally expandable spine 100 in an expanded configuration. Laterally expandable spine 100 is formed of two interconnected portions 102 and 104 that may be slid apart in order to expand the width of spine 100. In order to allow for the expansion of spine 100, module rods 106 and latching device 108 are also configured to expand in order to accommodate the varying width of spine 100. Rods 106 are formed of two separate rods 110 and 112. Rod 110 is hollow. Rod 112 has a shaft 114 protruding therefrom that slides into the interior hollow portion of rod 110, thereby keeping rod 106 contiguous. Similarly, latching device 108 is formed of a hollow bar 116 and a bar 118 that extends into the hollow portion of hollow bar 116, thereby keeping latching device 108 contiguous for the varying widths of spine 100. Spine 100 further includes a window 122 through which a user can read information on the spines of document modules held within spine 100. Spine 100 includes a guide and retaining portion 124 that extends from interconnected portion 102 into a hollow guide portion 126 within the other interconnected portion 104. Guide and retaining portion 124 is configured to maintain the structural integrity of spine 100 as it is laterally expanded and contracted. Interconnected portion 102 includes protrusions 128 and 130, each of which have a connector 132. Interconnected portion 104 includes protrusions 134 and 136 which having openings 138 and 140. Connectors 132 extend through openings 138 and 140 and secure protrusions 134 and 136 to 128 and 130, thereby providing additional structural rigidity to spine 100 as its width is varied. Connectors 132 can be adjustable between locked and unlocked positions. In an unlocked position, connectors 132 allow protrusions 134 and 136 to slide with respect to protrusions 128 and 130. In a locked position, connectors 132 prevent protrusions 134 and 136 from sliding with respect to protrusions 128 and 130. FIG. 14 depicts a perspective view of a laterally expandable spine 100 in an unexpanded configuration. FIG. 14 shows spine 100 completely closed and in an unexpanded configuration. In this unexpanded configuration, interconnecting portions 102 and 104 directly abut each other and guide portion 124 is not visible as it is wholly contained within spine 100.

FIG. 15 illustrates a perspective view of a binder spine 142 having a plurality of module spines 146 attached to a plurality of latching devices 144. Five modules 146 are shown attached to spine 142. The use of five modules 146 is merely exemplary. Spine 142 can be configured to hold any number of modules 146. Each module 146 is attached to spine 142 by an upper connector 148 and a lower connector 150. FIG. 16 illustrates a perspective view of binder spine 142 showing the various interactions of modules 146 with the latching devices 144. Upper connectors 148 have a tapered end 152 to facilitate the connection of modules 146 to binder spine 142. Each latching device 144 is provided with a top ergonomic surface for operation by a user. A tapered rod 154 is connected to the bottom of each latching device 144 A protrusion 156 also extends from a rear portion of latching device 144. Latching devices 144 are pivotally attached to binder spine 142. Tapered rod 154 mates with hole 158 formed in the top of module 144. Tapered rod 154 and hole 158 are both round in this exemplary embodiment, allowing module 146 to pivot with respect to binder 142. In an alternative embodiment, rod 154 and hole 158 could be made to have a non-round configuration, thereby preventing module 146 from pivoting with respect to binder 142. In FIG. 16, two modules 146 are shown connected to binder 142. Two latching devices 144 are shown in an open configuration unconnected to any module 146. One module 146 in the middle of binder 142 is shown in a position where it is about to be connected to binder 142. When a module 146 is connected to binder 142, a top end of module 146 presses against protrusion 156. Pressing against protrusion 156 causes latching device 144 to pivot such that rod 154 engages hole 158. When module 146 is fully connected to spine 142, module 146 will have caused latching device 144 to fully pivot such that it is in a closed and locked position. When in a closed an locked position, protrusion 156 is generally parallel to a lengthwise axis of module 146.

In this embodiment, latching device 144 functions in the same manner as a ski-boot binding. Openings 160 formed in modules 146 are configured to mate with connectors 148 and 150. The top ends of connectors 148 and 150 hold modules 146 laterally against binder spine 142. Latching devices 144 are moved from an unlocked position to a locked position when the top ends of module spines 146 engage protrusions 156. Latching devices 144 are self-locking when they engage a module 146. Latching device 144 restrains module 146 from moving along the longitudinal axis of binder spine 142. Together, latching device 144 and connectors 148 and 150 hold module 146 against binder spine 142. To close latching devices 144 without the presence of a module 146, a user pushes latching device 144 into a closed position. To unlock latching device 144, a user pulls up on latching device 144, which releases module 146 from being restrained in one axial direction. The module 146 can therefore be removed by pulling it up from engagement with connectors 148 and 150.

Openings 162 are provided in spine 142 to enable a user to read labels placed on the modules 146.

FIG. 17 illustrates a detailed perspective view of the latching devices 144. The left two latching devices 144 are shown in an unlocked configuration unattached to any module 146. The right two latching devices 144 are shown in a locked position attached to two modules 146 where rods 154 have mated with holes 158. The middle latching device 144 is shown in the process of being attached to module 146 where the top end of module spine 146 is about to engage protrusion 156. Openings 164 are provided to allow for the movement of latching device 144 and protrusions 156 in particular.

FIG. 18 illustrates a perspective view of a binder spine 166 having a plurality of modules 144 attached to a plurality of latching devices 168. Modules 146 are laterally held to binder spine 166 by connectors 148 and 150. Latching devices 168 and connectors 148 and 150 cooperate together to hold modules 146 to binder spine 142 along a lengthwise axis of binder spine 166. FIG. 19 illustrates a perspective view of binder spine 166 showing the various interactions of modules 146 with the latching devices 168. Latching devices 168 include tapered rods 170 that mate with holes 158 formed in the top ends of modules 146. Latching devices 168 lack protrusions 156 found in latching devices 144. Latching devices 168 are closed manually over modules 146 once modules 146 have been placed on connectors 148 and 150. Openings 172 formed in spine 166 allow latching devices 168 to pivot. FIG. 20 illustrates a detailed perspective view of the latching devices 168. Openings 172 formed in spine allow latching devices 168 to pivot between locked and unlocked positioned. Rods 170 are tapered to facilitate their engagement with holes 158 formed in modules 146.

Figures 21, 22, 23:
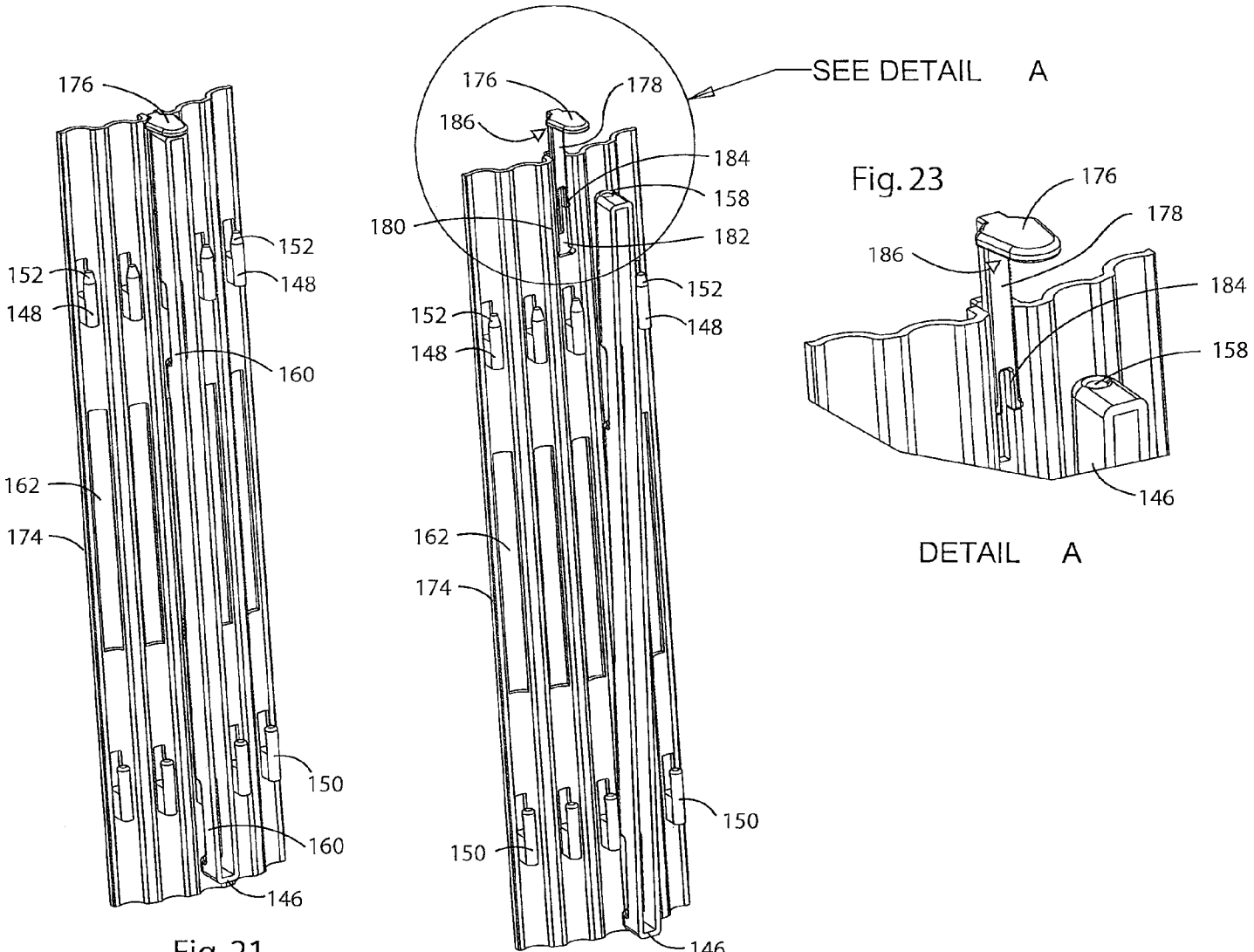
FIG. 21 illustrates a perspective view of a binder spine having a plurality of modules attached to a plurality of latching devices.
FIG. 22 illustrates a perspective view of a binder spine showing the removal of a module from the latching devices.
FIG. 23 illustrates a detailed perspective view of the latching devices.

FIG. 21 illustrates a perspective view of a binder spine 174 having a module 146 attached a latching device 176. Binder spine 174 includes windows 162 through which a user can view labels attached to modules 146. Binder spine 174 is provided with connectors 148 and 150 that mate with openings 160 formed in module 146. Latching device 176 connects to a top end of module 146. Together, latching device 176 and connectors 148 and 150 hold module 146 against binder spine 174. FIG. 22 illustrates a perspective view of binder spine 174 showing the removal of a module 146 from the latching device 176. Latching device 176 slides with respect to binder spine 174. Latching device 176 has a protrusion 178 that slides within channel 180 formed in binder spine 174. Channel 180 is provided with notches 182 formed at the bottom end. Prongs 184 formed at the bottom end of latching device 176 mate with notches 182 to hold latching device 176 in position when it is locked into position against module 146. Latching device 176 is provided with a rod 186 that engages holes 158 formed in the top end of module 146. FIG. 23 illustrates a detailed perspective view of the latching devices 176. Prongs 184 extend from the base of protrusion 178 and engage notches 182 shown in FIG. 22. Rod 186 mates with hole 158 in module 146 to hold module 146 in position against binder spine 174.

FIG. 24 illustrates a perspective view of a binder spine 188 having a plurality of modules 146 attached to a plurality of latching devices 190. FIG. 25 illustrates a perspective view of binder spine 188 showing the various interactions of modules 146 with latching devices 190. Latching devices 190 slide with respect to binder spine 188 between locked and unlocked positions to hold modules 146 in position against binder spine 188. Latching devices 190 are provided with spines 194 and connectors 196. Latching devices 190 slide within channels 198. Together, connectors 192 and 196 function to engage openings 160 and attach modules 146 to binder spine 188. In this embodiment, connector 196 moves with respect to connector 192 in order to create locked and unlocked configurations. FIG. 26 illustrates a detailed perspective view of the latching devices 190. Connector 196 slides between a locked and unlocked position. When in an unlocked position, module 146 may be pulled away from connector 196. When in a locked position, module 146 is held between connectors 196 and 192 and cannot be pulled away from binder spine 188.

While the invention has been shown and described with reference to a particular embodiment thereof, it will be understood to those skilled in the art, that various changes in form and details may be made therein without departing from the spirit and scope of the invention.

What is claimed is:

1. A system for holding a plurality of loose leaf sheets, comprising:

a spine having top and bottom ends;

a plurality of latching devices connected to the spine, each latching device comprising:

a first retaining member, a latching member, and a second retaining member, said first and second retaining members being spaced from each other along a longitudinal axis of said spine; and a plurality of modules each adapted to attach to a respective one of the plurality of latching devices, each module being configured to releasably hold a plurality of the loose leaf sheets, each module comprising a first portion contoured to mate with a portion of an external profile of said first retaining member of said respective one of the plurality of latching devices, and a second portion contoured to mate with a portion of an external profile of said second retaining member of said respective one of the plurality of latching devices, wherein each said latching member is movable between a latched position that prevents a respective one of said modules from separating from the respective latching device, and an unlatched position where the respective one of said modules may be removed from said binder, wherein each latching member of said plurality of latching devices is independently movable between its latched and unlatched positions such that each module can be removed or attached to said spine independent of every other module attached to said spine.

2. The binder of claim 1, wherein each of said modules is pivotable with respect to said spine when it is removeably attached to said spine.

3. The binder of claim 1, wherein each said second retaining member is a rod.

4. The binder of claim 1, wherein each said second retaining member is a hook.

5. The binder of claim 3, wherein the second portion of each said module has a contour configured to mate with a portion of an external profile of each said rod.

6. The binder of claim 1, wherein each said latching member pivots between latched and unlatched positions.

7. The binder of claim 6, wherein each said latching member slides along a path parallel to the longitudinal axis between latched and unlatched positions.

8. The binder of claim 6, wherein a latching rod is attached to each said latching member.

9. The binder of claim 6, wherein a curved latching surface is attached to each said latching member.

10. The binder of claim 8, wherein each said latching member comprising an ergonomic surface.

11. A binder for holding loose leaf sheets, comprising:

a spine having top and bottom ends;

a plurality of module locking devices, each module locking device comprised of a locking member and an attaching surface at one of the top and bottom ends; and at least a pair of modules, each being separately removeably attached to said spine, each module being configured for releasably holding a plurality of the loose leaf sheets, each module having a contoured end configured to engage an outer surface of said attaching surface of a respective one of the plurality of module locking devices, said locking member of the respective one of the plurality of module locking devices being movable between a locked position where it engages the contoured end of the respective one of said modules, thereby holding each said module in a removeably attached position, and an unlocked position where said respective one of said modules may be removed from said binder, whereby each module can be removed or attached to said spine independent of every other module attached to said spine.

12. The binder of claim 11, wherein said modules may pivot with respect to said spine when they are removeably attached to said spine.

13. The binder of claim 11, wherein said locking member pivots between locked and unlocked positions.

14. The binder of claim 11, wherein each said locking member slides along a path parallel to a longitudinal axis of the spine between locked and unlocked positions.

15. The binder of claim 14, wherein a module rod is positioned perpendicular to a lengthwise axis of said module.

16. The binder of claim 13, wherein a module rod is attached to said locking member.

17. The binder of claim 11, wherein said locking member comprises a curved surface for engaging the contoured end of said module.

18. The binder of claim 11, wherein the pair of modules is selected from the group consisting of a module that attaches to documents using a clip, a module that attaches to documents using a three-ring binding system, and a module that uses a pocket.

19. A binder for holding loose leaf sheets, comprising:

a spine;

a pair of cover flaps attached to said spine;

a rod attached to said spine, said rod positioned parallel to a planar surface of said spine and perpendicular to a lengthwise axis of said spine;

a locking device; and a plurality of modules removeably attached to said spine between said cover flaps, each of said plurality of modules being configured to releasably hold a plurality of the loose leaf sheets, each of said plurality of modules having a first end that includes a curved surface configured to mate with an external curved surface of said rod, wherein said locking device is slidably moveable along the lengthwise axis of the spine between locked and released positions, wherein the locked position comprises a position in which the locking device engages the plurality of modules and prevents the plurality of modules from detaching from the spine, wherein said plurality of modules are removeably attached to said spine when the curved surface of the first end is mated with said rod and said locking device is in the locked position, and wherein the released position comprises a position in which the modules may be detached from the spine.

20. The binder of claim 19, wherein said spine is expandable perpendicularly to the lengthwise axis of the spine.

21. The binder of claim 19, said locking device comprises a bar that slides along the lengthwise axis of the spine so as to slide over the first end of each of said plurality of modules.

22. The system of claim 1, wherein the first and second retaining members of each of the plurality of latching devices are rigidly mounted to the spine.

23. The system of claim 1, wherein the latching member of each of said plurality of latching devices is movable between its latched and unlatched positions relative to the first and second retaining members of the respective latching device.

24. The system of claim 20, wherein said spine is expandable perpendicularly to the lengthwise axis of the spine to accommodate a greater number of said plurality of modules.

25. The system of claim 1, wherein, when one of the modules is attached to the spine, at least one of the first and second retaining members of the respective latching device is positioned entirely between longitudinal ends of the respective module, as measured along the longitudinal axis of the spine.

26. The system of claim 1, wherein, when one of the modules is attached to the spine, the first and second retaining members of the respective latching, device are both positioned entirely between longitudinal ends of the respective module, as measured along the longitudinal axis of the spine.

27. The system of claim 1, wherein, with respect to each of the plurality of latching devices:

each of the first and second retaining members comprise a projecting portion and a support connecting the projecting portion to the spine, and when the respective latching member is in its latched position, the projecting portion of each of the first and second retaining members projects away from its respective support in a first direction along the longitudinal axis.

28. The system of claim 1, wherein, with respect to each latching device, the first retaining member slides with the latching member relative to the second retaining member along a path parallel to the longitudinal axis between the latched and unlatched positions.

29. A binder for holding loose leaf sheets, comprising:

a binder spine;

a retaining member supported by the binder spine and projecting along a longitudinal axis;

a module configured to releasably hold a plurality of the loose leaf sheets, the module being movable relative to the retaining member between a retained position and a released position, the retained position comprising a position in which the retaining member engages the module and prevents the module from separating from the retaining member perpendicularly to the longitudinal axis, the released position comprising a position in which the module can move away from the binder spine perpendicularly to the longitudinal axis; and a latch movable relative to the binder spine between locked and unlocked positions, wherein the latch is positioned and configured such that in its unlocked position, the module is movable into and out of its released and retained positions, and wherein the latch is positioned and configured such that in its locked position, the latch prevents the module in its retained position from moving into its released position.

30. The binder of claim 29, wherein:

the retaining member comprises a first retaining member;

the module comprises a first module;

the latch comprises a first latch;

the longitudinal axis comprises a first longitudinal axis;

the binder further comprises:

a second retaining member supported by the binder spine and projecting along a second longitudinal axis that is parallel to and spaced from the first longitudinal axis, a second module configured to releasably hold a plurality of the loose leaf sheets, the second module being movable relative to the second retaining member between a retained position and a released position, the retained position of the second module comprising a position in which the second retaining member engages the second module and prevents the second module from separating from the second retaining member perpendicularly to the second longitudinal axis, the released position of the second module comprising a position in which the second module can move away from the binder spine perpendicularly to the second longitudinal axis, and a second latch movable relative to the binder spine between locked and unlocked positions, wherein the second latch is positioned and configured such that in its unlocked position, the second module is movable into and out of its released and retained positions, wherein the second latch is positioned and configured such that in its locked position, the second latch prevents the second module in its retained position from moving into its released position, and wherein the first and second latches are independently movable between their locked and unlocked positions.

31. The binder of claim 29, wherein the module comprises a module spine having an engagement portion on its exterior side, the engagement portion being shaped and configured to engage the retaining member when the module moves into its retained position.

32. The binder of claim 31, wherein the engagement portion comprises a channel in the exterior side of the module spine.

33. The binder of claim 29, wherein:

the retaining member comprises a first retaining member;

the binder further comprises a second retaining member that projects along the longitudinal axis and is spaced from the first retaining member along the longitudinal axis;

the retained position comprises a position in which the first and second retaining members engage the module and prevent the module from separating from the retaining member perpendicularly to the longitudinal axis.

34. The binder of claim 33, wherein the first and second retaining members are rigidly mounted to the binder spine.

35. The binder of claim 33, wherein the latch is movable between its locked and unlocked positions relative to the first and second retaining members.

36. The binder of claim 33, wherein:

each of the first and second retaining members comprise a projecting portion and a support connecting the projecting portion to the binder spine, and when the latch is in its locked position, the projecting portion of each of the first and second retaining members projects away from its respective support in a first direction along the longitudinal axis.

37. The binder of claim 29, wherein, the retaining member is positioned and configured such that when the module is in its retained position, the retaining member is disposed entirely between longitudinal ends of the module, as measured along the longitudinal axis.

38. The binder of claim 29, wherein the module is linearly movable along the longitudinal axis relative to the retaining member between the retained and released positions.

* * * * *

UNITED STATES PATENT AND TRADEMARK OFFICE

CERTIFICATE OF CORRECTION

PATENT NO. : 7,802,938 B2
APPLICATION NO. : 11/860982
DATED : September 28, 2010
INVENTOR(S) : Christopher Holman It is certified that error appears in the above-identified patent and that said Letters Patent is hereby corrected as shown below:

Title Page, Item (54) Title: should read,
--MODULAR FILING SYSTEM--.

Title Page, Item (75) Inventors: should read,
--Christopher HOLMAN, Mesa, AZ (US)
Michael AITCHISON, Glendale, AZ (CA)
Barry ROBB, Scottesale, AZ (US)
Brian CAUSSE, Phoenix, AZ (US)
David GRUZA, Phoenix, AZ (US)
Andrew GOODFELLOW, Phoenix, AZ (UK)--.

Signed and Sealed this

Seventh Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,802,938 B2
APPLICATION NO. : 11/860982
DATED : September 28, 2010
INVENTOR(S) : Christopher Holman It is certified that error appears in the above-identified patent and that said Letters Patent is hereby corrected as shown below:

Title Page, Item (54) and at Column 1, lines 1 and 2, Title: should read,
--MODULAR FILING SYSTEM--.

Title Page, Item (75) Inventors: should read,
--Christopher HOLMAN, Mesa, AZ (US)
Michael AITCHISON, Glendale, AZ (CA)
Barry ROBB, Scottesale, AZ (US)
Brian CAUSSE, Phoenix, AZ (US)
David GRUZA, Phoenix, AZ (US)
Andrew GOODFELLOW, Phoenix, AZ (UK)--.

This certificate supersedes the Certificate of Correction issued December 7, 2010.

Signed and Sealed this
First Day of February, 2011

David J. Kappos

David J. Kappos
*Director of the United States Patent and Trademark Office*